US009073185B2

(12) United States Patent
Oachs et al.

(10) Patent No.: US 9,073,185 B2
(45) Date of Patent: Jul. 7, 2015

(54) UNIVERSAL ADJUSTABLE FAN CLUTCH HOLDING TOOL

(71) Applicant: A&E INCORPORATED, Racine, WI (US)

(72) Inventors: Joshua Oachs, Racine, WI (US); Timothy J Alho, Pleasant Prairie, WI (US); Jason Horner, Burlington, WI (US); Maximilian N Knoell, Racine, WI (US)

(73) Assignee: A & E Incorporated, Racine, WI (US)

( * ) Notice: Subject to any disclaimer, the term of this patent is extended or adjusted under 35 U.S.C. 154(b) by 196 days.

(21) Appl. No.: 13/688,513

(22) Filed: Nov. 29, 2012

(65) Prior Publication Data

US 2013/0133198 A1 May 30, 2013

Related U.S. Application Data

(60) Provisional application No. 61/565,143, filed on Nov. 30, 2011.

(51) Int. Cl.

| | |
|---|---|
| ***B25B 1/00*** | (2006.01) |
| ***B25B 13/48*** | (2006.01) |
| ***B25B 27/00*** | (2006.01) |

(52) U.S. Cl.

CPC ..... *B25B 13/481* (2013.01); *Y10T 29/49245* (2015.01); *B25B 13/48* (2013.01); *B25B 27/0035* (2013.01); *B25B 27/0064* (2013.01)

(58) Field of Classification Search

USPC ..... 269/3, 6, 95, 143, 249; 81/176.1, 81/176.15, 176.2, 176.3, 126, 127

See application file for complete search history.

(56) References Cited

U.S. PATENT DOCUMENTS

| | | | | |
|---|---|---|---|---|
| 4,296,655 | A * | 10/1981 | Tesoro | 81/405 |
| 4,581,960 | A * | 4/1986 | Putsch et al. | 81/411 |
| 5,016,503 | A * | 5/1991 | Morton | 81/127 |
| 5,285,703 | A * | 2/1994 | Carson | 81/423 |
| 6,237,449 | B1 * | 5/2001 | Orlosky | 81/360 |
| 7,299,724 | B1 * | 11/2007 | Warheit et al. | 81/409.5 |
| 2002/0083803 | A1 * | 7/2002 | Ping | 81/394 |
| 2005/0217437 | A1 * | 10/2005 | Whitehead et al. | 81/176.3 |
| 2009/0178518 | A1 * | 7/2009 | Buchanan et al. | 81/324 |

* cited by examiner

*Primary Examiner* — Lee D Wilson

*Assistant Examiner* — Nirvana Deonauth

(74) *Attorney, Agent, or Firm* — Ryan Kromholz & Manion, S.C.

(57) ABSTRACT

An adjustable holding tool is provided for servicing a fan clutch assembly removably attached to a shaft of a water pump having a pulley associated therewith. A holding tool is comprised of a first plate holder including a first adjustment leg joined to a first attachment leg having a first longitudinal axis and a first attachment structure. A second plate holder includes a second adjustment leg joined to a second attachment leg having a second longitudinal axis and second attachment structure. The first and second plate holders are slidably connected together to provide a continuous variable spacing between the first and second adjustment legs while maintaining a parallel relationship between the first and second longitudinal axes.

8 Claims, 16 Drawing Sheets

108
70
66
40
64
72
70
74
76
76
70
74
74
74

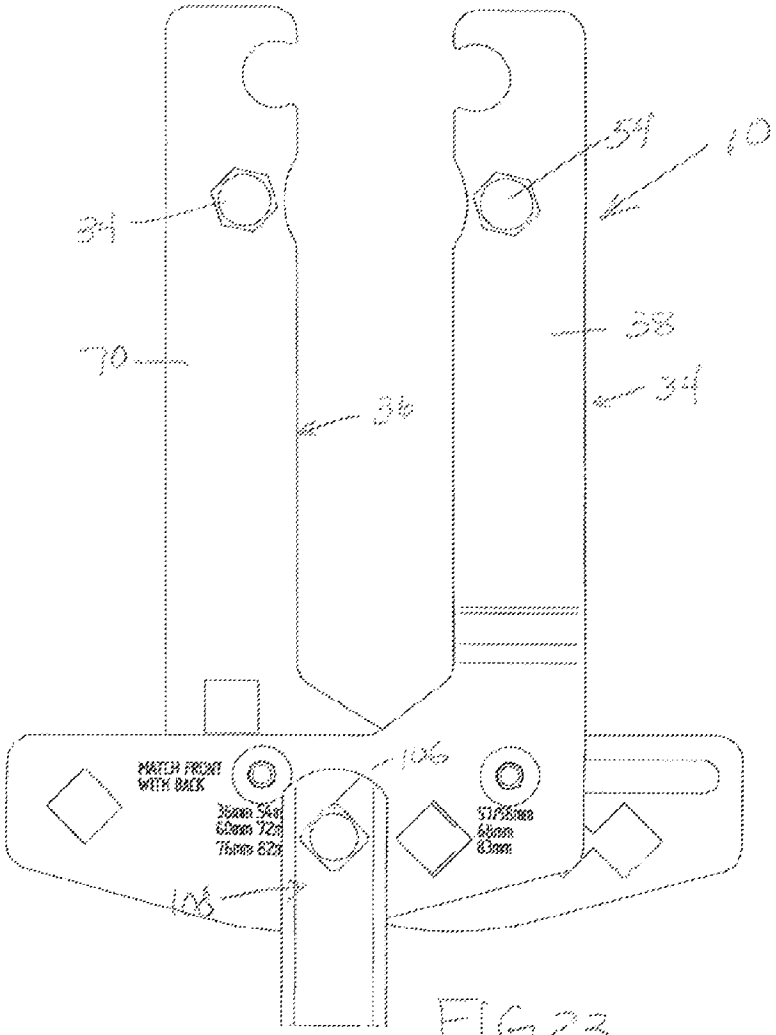
10
34
38
36
70
72
74
76
78
80
82
84
86
88
90
92
94
96
98
100
102
104
106
108
110
112
114
116
118
120
122
124
126
128
130
132
134
136
138
140
142
144
146
148

UNIVERSAL ADJUSTABLE FAN CLUTCH HOLDING TOOL

RELATED APPLICATIONS

This application claims the benefit of co-pending U.S. Provisional Application Ser. No. 61/565,143 Filed 30 Nov. 2011.

FIELD OF THE INVENTION

The present invention relates generally to tools used in the removal or replacement of fan clutch assemblies and water pumps. More particularly, the invention pertains to an adjustable tool used to maintain a water pump pulley in fixed position as the fan clutch assembly is removed or replaced.

BACKGROUND OF THE INVENTION

Automotive vehicles, especially sport utility vehicles, pick-up trucks and vans, required periodic service of the viscous fan clutch assembly or water pump. The viscous fan clutch assembly is coupled to a threaded shaft of a water pump with a threaded coupling. This shaft is freewheeling, and must be controlled to prevent its rotation when connecting or disconnecting the shaft to the viscous fan clutch assembly. The common method of removing the viscous fan clutch assembly is to hold the water pump fully stationary with a holding wrench. Such holding wrenches are relatively thin in order to fit into a constricted space between the water pump pulley and the fan clutch assembly. Then, using an open ended turning wrench engaging the threaded coupling on the viscous fan clutch assembly, with an opposite turning motion, the viscous fan clutch assembly is unthreaded from the water pump threaded shaft. With this method, the viscous fan clutch assembly may be removed and replaced, and thereafter the water pump may also be removed and replaced.

Some water pump pulleys are held to the water pump by a number of fasteners (i.e. bolts and nut assemblies). These bolts or nuts are usually in a group of four, five, or even more, and extend from the surface of the water pump pulley. The bolts or nuts are accessed and held by the holding wrench after which the turning wrench is used to remove or replace the viscous fan clutch assembly. Other pulleys are pressed onto the water pump and are each formed with a number of recesses, the walls of which are engaged by protrusions on the holding wrench to hold the pulley in place before the turning wrench is employed to remove or replace the viscous fan clutch assembly. Certain pulleys have outer surfaces with other configurations, such as raised flats and central nut designs, which need to be engaged to keep the pulley stationary before the turning wrench is applied.

Because of the variety in the shape and sizes of pulleys and because of the variation of the design, spacing and positioning of the fasteners, recesses and other engagement surfaces on these pulleys, it has been necessary to select the proper holding tool from a set of multiple holding tools when servicing water pumps and fan clutch assemblies. While some known holding tools and wrenches claim to be used with a wide variety of water pump pulleys, there remains a need to provide a single adjustable holding tool capable of universal application regardless of the size and the configuration of the pulleys.

SUMMARY OF THE INVENTION

The present disclosure relations to an adjustable holding tool for servicing a fan clutch assembly removably attached to a shaft of a water pump having a pulley associated therewith. The holding wrench comprises a first plate holder including a first adjustment leg joined to a first attachment leg having a first longitudinal axis and first attachment structure adapted to engage the pulley. A second plate holder includes a second adjustment leg joined to a second attachment leg having a second longitudinal axis and second attachment structure adapted to engage the pulley. The first and second plate holders are slidably connected together to provide a continuous variable spacing between the first and second adjustment legs while maintaining a parallel relationship between the first and second longitudinal axes.

The present disclosure also contemplates a method for removing or replacing a fan clutch assembly of the type having a nut threaded on a rotatable shaft of the water pump associated with a pulley fixed to the shaft and having engagement structure provided thereon. The method includes the steps of a) providing an adjustable holding tool defined by a first plate holder including a first adjustment leg joined to a first attachment leg having a first longitudinal axis and a first attachment structure, and a second plate holder including a second adjustment leg joined to a second attachment having a second longitudinal axis and a second attachment structure wherein the first and second plate holders are slidably connected together to provide a continuous variable spacing between the first and second attachment legs while maintaining a parallel relationship between the first and second longitudinal axes; b) slidably adjusting the first and second plate holders to provide a desired spacing of the first and second attachment legs such that the first and second attachment structure of the first and second attachment legs is engaged with the engagement structure of the pulley to hold the pulley stationary; c) placing a turning wrench on the nut of the fan clutch assembly to tightly grip the nut; and d) pivoting the turning wrench on the nut while maintaining the first and second attachment structure engaged with the engagement structure of the pulley to loosen and remove the nut from the shaft or replace the nut on the shaft as desired.

BRIEF DESCRIPTION OF THE DRAWINGS

The drawings illustrate the best mode presently contemplated in carrying out the disclosure.

In the drawings:

FIGS. 22 and 23 illustrate the holding tool held in different spacing arrangements.

DETAILED DESCRIPTION OF THE INVENTION

Figure 1:
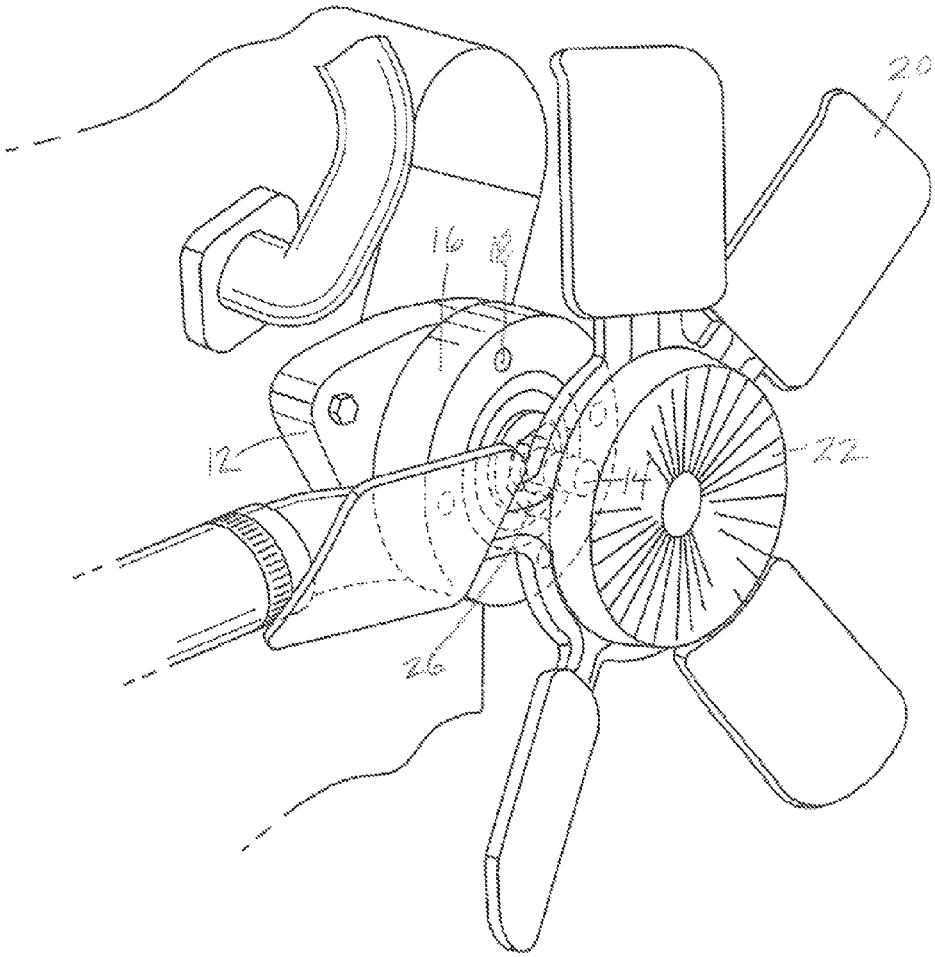
FIG. 1 is a perspective view of a typical fan clutch assembly threadably attached to a shaft of a water pump having a pulley on which an adjustable fan clutch holding tool of the present disclosure is utilized.
Figure 2:
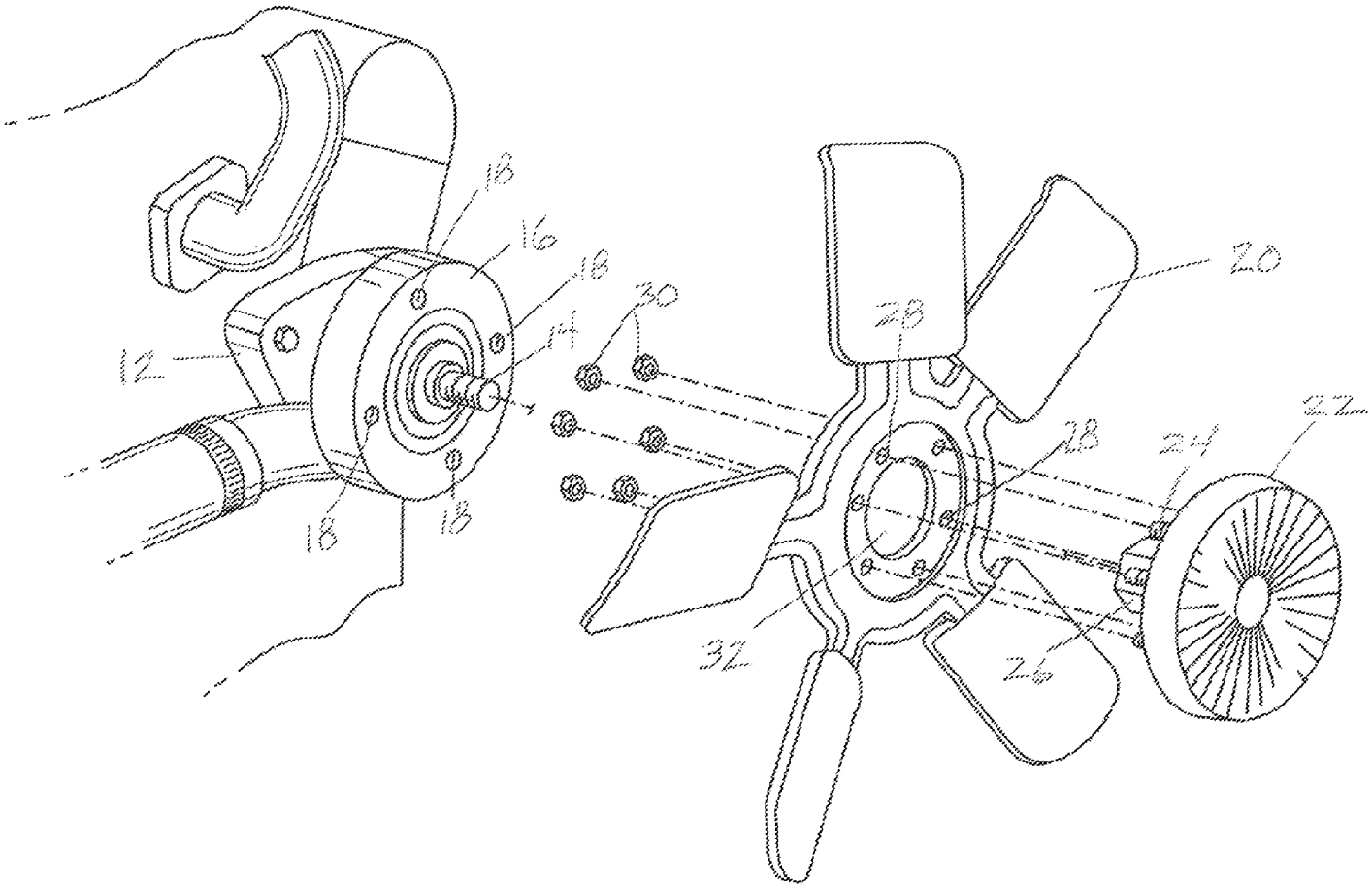
FIG. 2 is an exploded view of FIG. 1.
Figure 3A:
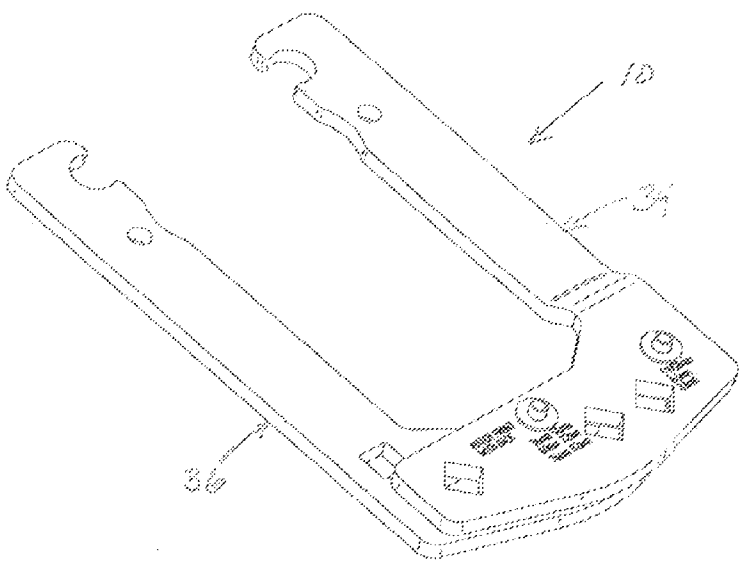
FIGS. 3 and 3A are top perspective views of the holding tool embodying the present disclosure.

Referring now to the drawings, FIGS. 1 and 2 depict a typical environment within a vehicle engine compartment wherein an adjustable fan clutch pulley holding tool 10 embodying the present invention is used in the servicing of fan clutch assemblies and water pumps. Both figures illustrate a water pump 12 having a freewheeling threaded shaft 14 which extends through a threaded hole of a pressed on pulley 16 mounted to the water pump 12. Although not shown, the periphery of the pulley 16 is rotated by a driven serpentine belt which normally is entrained about crankshaft, alternator and other vehicular accessory pulleys. The pulley 16 shown in FIGS. 1 and 2 has an outer face provided with a series of spaced apart recesses 18 which are utilized to attach the holding tool 10 as will be described hereafter. It should be understood that the pulley 16 may have several other configurations with different engagement surfaces, and that the present invention contemplates various pulley designs as will be further explained below.

A fan 20 is joined to a fan clutch 22 in the form of a viscous coupling. The rear of the fan clutch 22 is provided with spaced bolts 24 and a connector or fan clutch nut 26. The bolts 24 extend through appropriate openings 28 in the central portion of fan 20, and are fixedly held thereto by a set of nuts 30 screwed on the bolts 24. Together, the fan 20 and the fan clutch 22 define a fan clutch assembly. The nut 26 projects through a central opening 32 in the fan 20 and is threadably secured to the shaft 14. The lengths of the shaft 14 and the nut 26 along with the depth of the attached fan 20 define a limited distance between the pulley 16 and the fan clutch assembly defined by the fan 20 and the fan clutch 22 when these components are interconnected. This limited distance makes it difficult to remove the fan clutch assembly from the shaft 14.

Previously in servicing fan clutch assemblies, a holding wrench or tool would be engaged with engagement structure on the pulley 16 to hold the pulley 16 stationary after which a separate turning wrench was used to engage and loosen the nut 26 so that the fan clutch assembly could be disconnected from the shaft 14. As described in the Background of the Invention, because of the differing designs, shapes and sizes of pulleys, multiple sets of holding wrenches or tools have been typically required to remove the nut 26 from the shaft 14 for different types of vehicles.

FIGS. 3-13 illustrate the versatile adjustable holding tool 10 which can be used in place of the multiple holding wrenches or tools previously needed. As will be appreciated hereafter, a key feature of the holding tool 10 is its adaptability to accommodate a wide variety of engagement structure or surfaces on various pulley configurations.

Holding tool 10 is configured of a rigid and durable metal construction having a first or front plate holder 34 and a second or back plate holder 36 which are connected together for selective sliding movement relative to one another.

Figure 8:
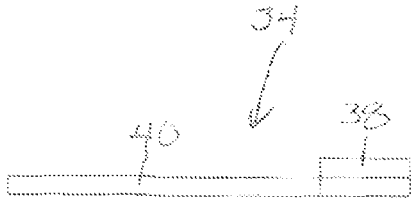
FIG. 8 is an elevational view taken from the top end of FIG. 7.
Figure 9:
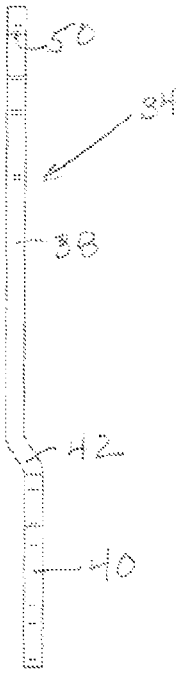
FIG. 9 is an elevational view taken from the left side of FIG. 7.
Figure 7:
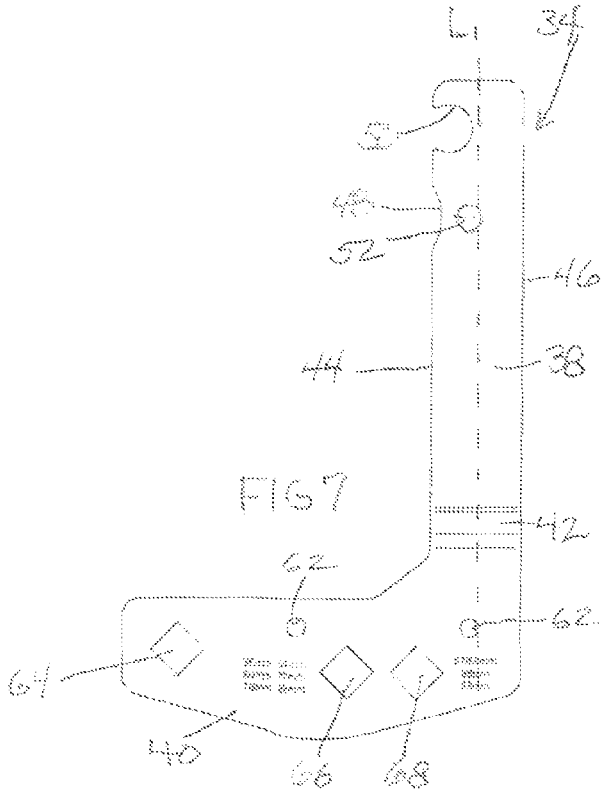
FIG. 7 is a top view of a front plate holder of the holding tool.

As seen in FIGS. 7-10, front plate holder 34 has a generally reverse L-shaped configuration and includes a vertically extending elongated attachment leg 38 which is integrally joined to a horizontally extending adjustment leg 40. As seen in FIGS. 8 and 9, the plate holder 34 is formed with an offset portion 42 such that the upper surfaces of legs 38, 40 lie in different planes. The attachment leg 38 of front plate holder 34 has a linear inner edge 44 and a linear outer edge 46 which both lie parallel to a longitudinal axis L1. The inner edge 44 is formed with an inwardly curved cutout 48 and an inwardly extending arcuate notch 50 at an upper end of leg 38. The leg 38 also includes a threaded throughhole 52 which lies inwardly of the cutout 48. The throughhole 52 is designed to receive and retain a fastener 54 (FIGS. 14 and 15) having a hex head 56, a threaded neck 58 and an unthreaded pin 60. The fastener 54 is designed to be threaded into the throughhole 52 from either the upper surface or the lower surface of the leg 38.

The adjustment leg 40 of front plate holder 34 is formed with a pair of spaced apart apertures 62 to facilitate attachment to the back plate holder 36. The leg 40 is also formed with a series of spaced apart square shaped recesses 64, 66, 68 which are utilized in the use of the holding tool 10 as will be detailed below.

Figure 13:
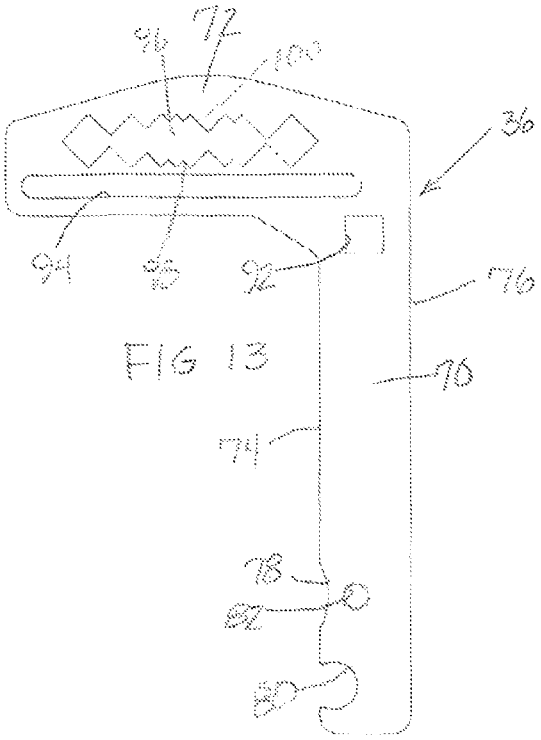
FIG. 13 is a bottom view of FIG. 11.
Figure 12:
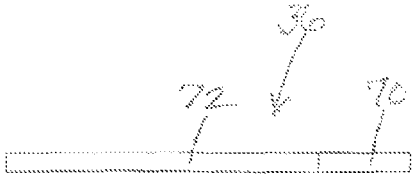
FIG. 12 is an elevational view taken from the top end of FIG. 11.
Figure 11:
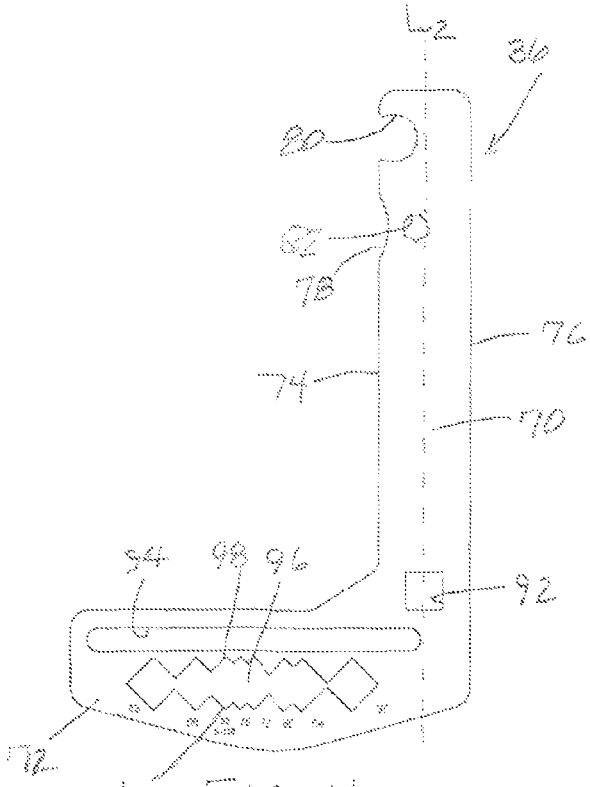
FIG. 11 is a top view of a back plate holder of the holding tool.

Referring to FIGS. 11-13, the back plate holder 36 also has a generally reverse L-shaped configuration and includes a vertically extending elongated attachment leg 70 which is integrally joined to a horizontally extending adjustment leg 72. As seen in FIG. 12, the plate holder 36 is formed such that upper surfaces of leg 70 and 72 are co-planar with each other. The attachment leg 70 of back plate holder 36 has a linear inner edge 74 and a linear outer edge 76 which both lie parallel to a longitudinal axis L2. The inner edge 74 is formed with an integrally curved cutout 78 and an inwardly curved arcuate notch 80 at an upper end of the leg 70. The leg 70 also includes a threaded throughhole 82 which lies inwardly of the cutout 78. The throughhole 82 is designed to receive and retain a fastener 84 (FIGS. 14 and 15) having a hex head 86, a threaded neck 88 and an unthreaded pin 90. The fastener 84 is designed to be threaded into the throughhole 82 from either the upper surface or the lower surface of the leg 70.

Figure 6:
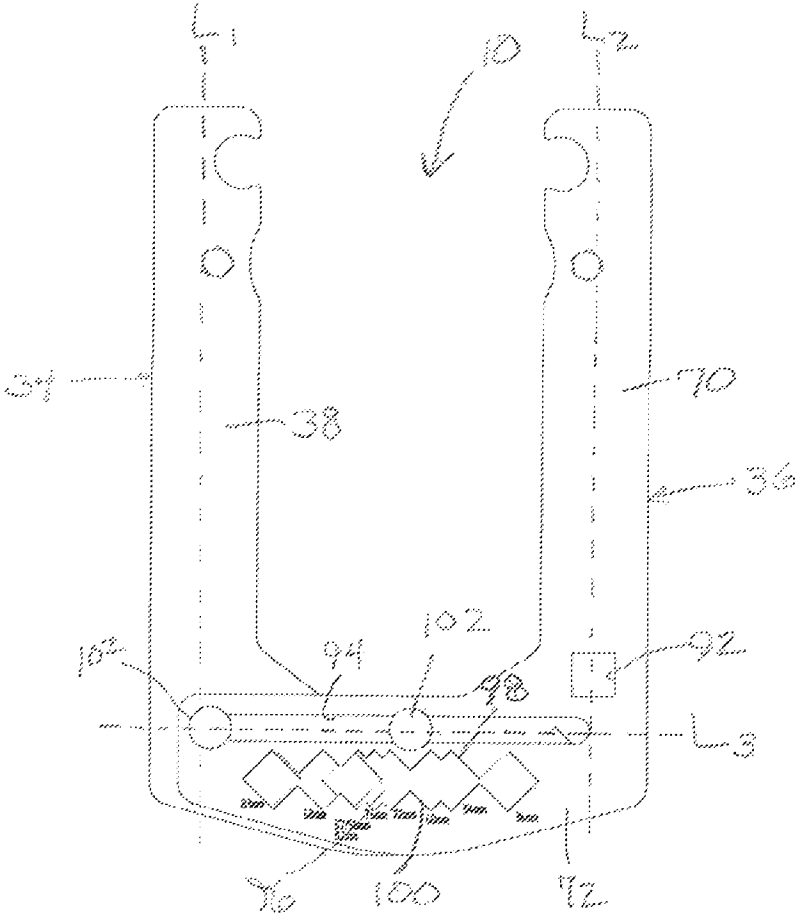
FIG. 6 is a bottom plan view of the holding tool shown in FIG. 4.
Figure 5:
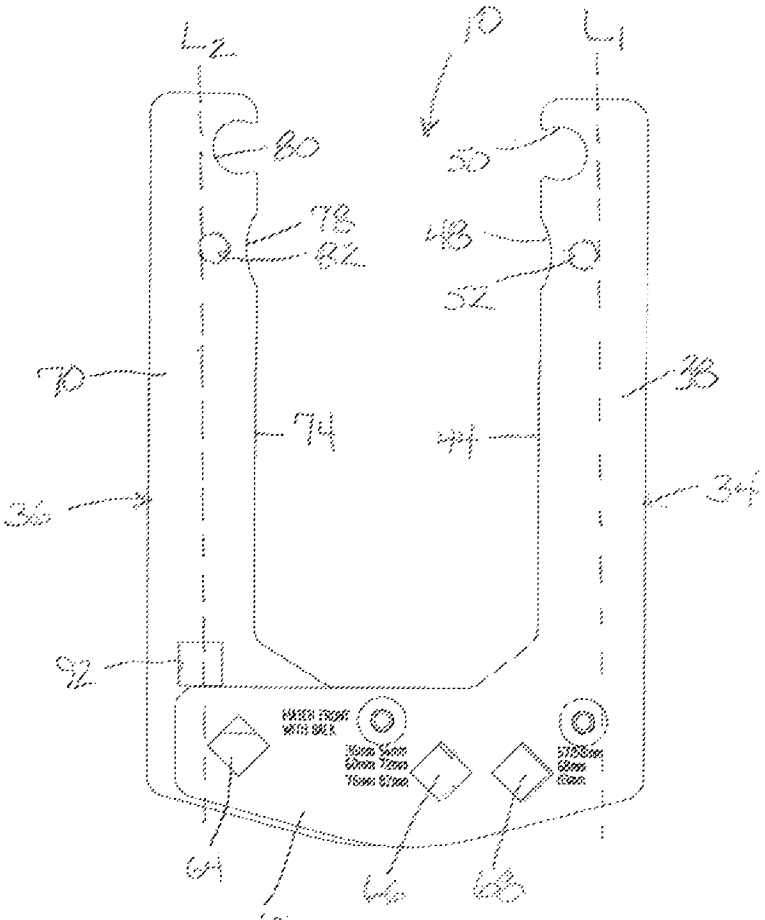
FIG. 5 is a top plan view of the holding tool shown in FIGS. 3 and 3A.
Figure 10:
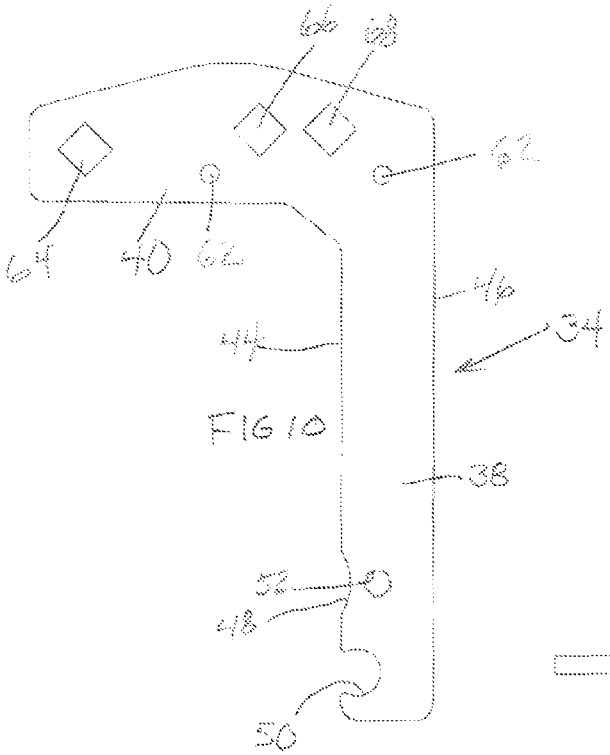
FIG. 10 is a bottom view of FIG. 7.

The adjustment leg 72 of back plate holder 36 is formed with a single square recess 92 and an elongated slot 94 which is designed to be aligned with the apertures 62 in the cooperating plate holder 34. The leg 72 is further configured with a recess 96 formed with saw tooth edges 98, 100. The edges 98, 100 of the recess 96 are designed to be variously alignable with the recesses 66, 68 on the plate holder 34 during use of the holding tool 10. As seen in FIGS. 5 and 6, the front faces of the adjustment legs 40, 72 adjacent the recesses 66, 68 and saw tooth edge 100 are provided with suitable indicia corresponding to the spacing distances between inner edges 44, 74 of respective attachment legs 38, 70.

Figure 4:
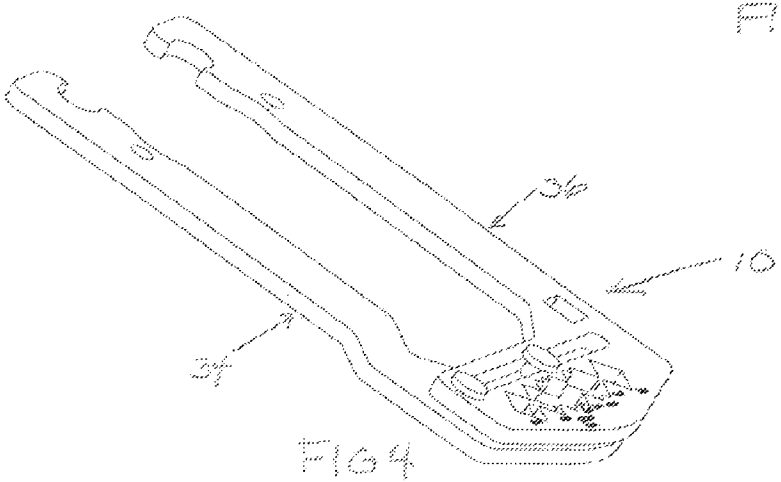
FIG. 4 is a bottom perspective view of the holding tool of FIGS. 3 and 3A.
Figure 3:
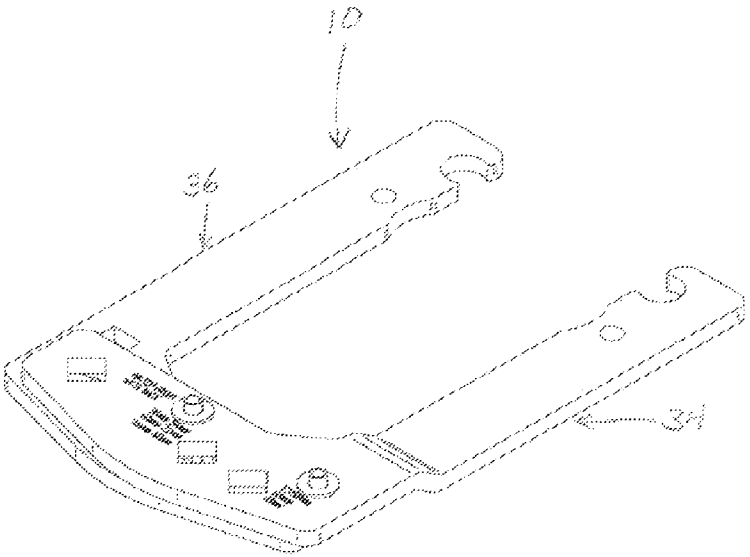
Figure 14:
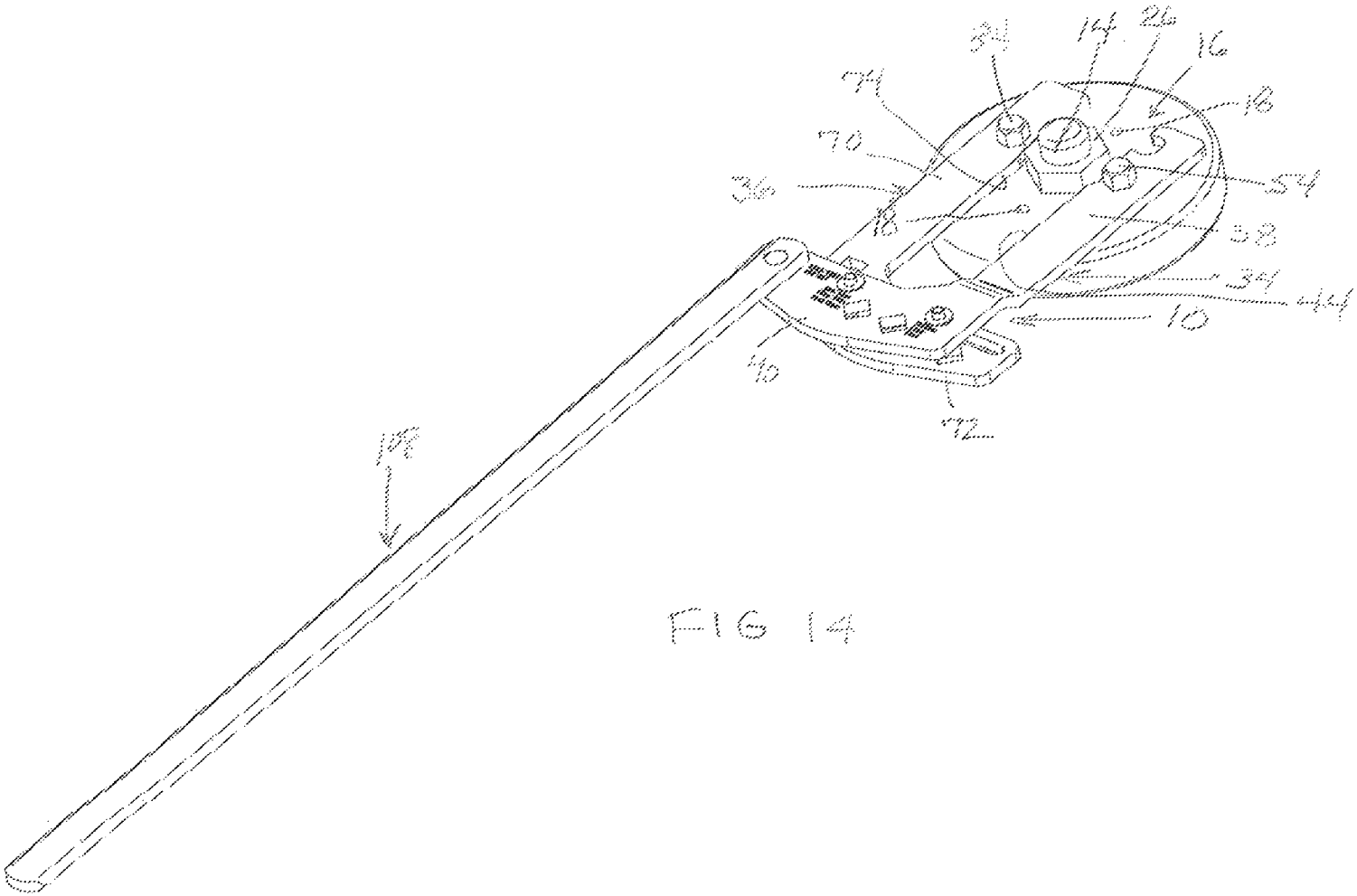
FIG. 14 is a perspective view of the holding tool engaged in an exemplary holding position on a first type of water pump pulley having holes and used with a breaker bar.
Figure 15:
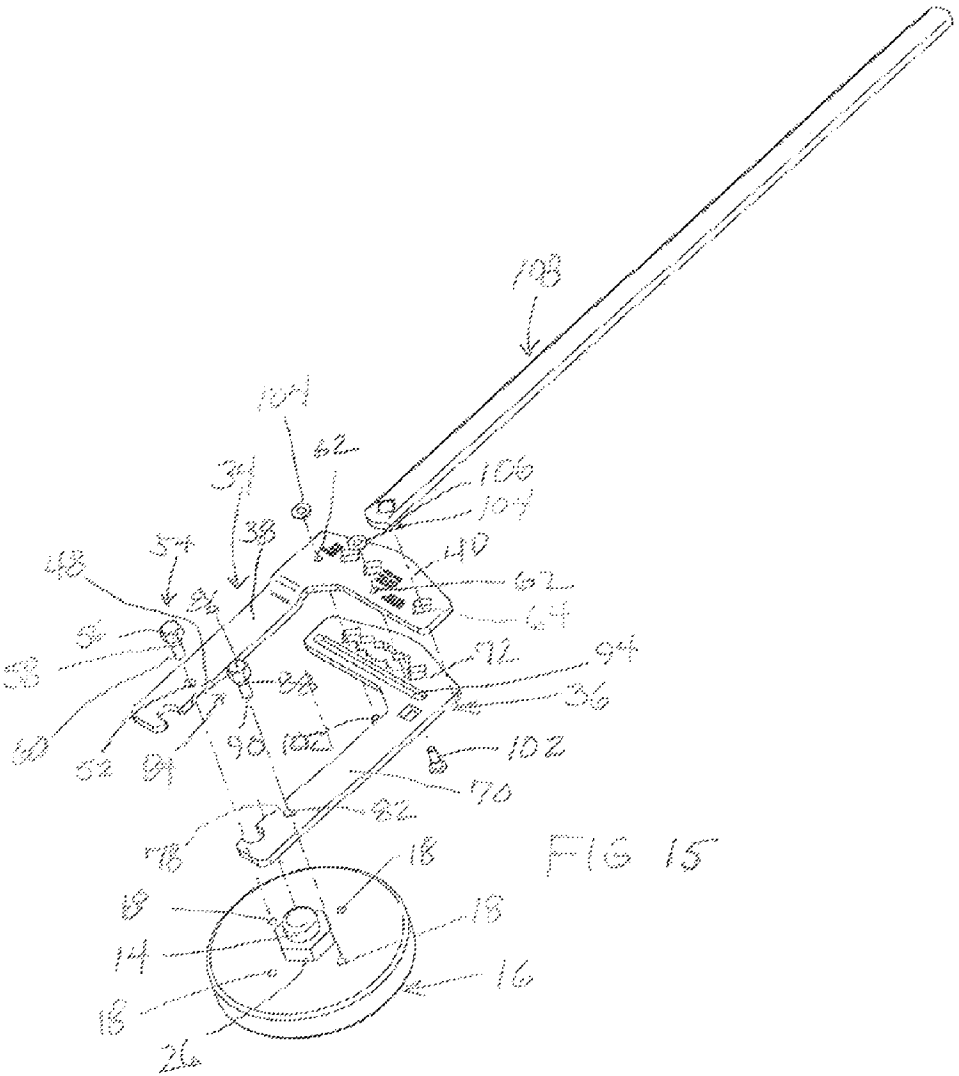
FIG. 15 is an exploded view of FIG. 14.

As illustrated in FIGS. 14 and 15, the assembly of the holding tool 10 involves placing the lower surface of leg 40 upon the lower surface of leg 72 in back-to-back overlying relationship such that the apertures 62 on leg 40 are aligned with the slot 94 on leg 72, and the arcuate recesses 50, 80 on legs 38, 70 face each other. Two fasteners, such as rivets 102, are passed through the aligned apertures 62 and slot 94 such that the heads of the rivets 102 abut the peripheral surface around the slot 94, such as shown in FIGS. 4 and 6. The shafts of the rivets or fasteners 102 project beyond the upper surface of leg 40 and pass through washers 104 before the shaft ends are crimped or otherwise fixed against the upper surface of leg 40.

With the above described assembly, the plate holders 34, 36 are slidably connected together by means of the pin and slot arrangement 94, 102 to enable the adjustment legs 40, 72 to move along each other, and to establish a continuous spacing between the attachment legs 38, 70 which is selectively adjusted while maintaining a parallel relationship between the respective longitudinal axis L1 and L2 of the legs 38, 70 (FIGS. 5 and 6). More specifically, the rivets 102 travel back and forth along a linear path defined by a longitudinal axis L3 passing through the slot 94 and extending generally perpendicularly to the axes L1 and L2. As will be more fully comprehended below, the alignment of the recesses 66, 68 with various apices of the saw tooth edges 98, 100 corresponds to select spacing between the adjustment legs 38, 70 on the plate holders 34, 36 respectively, during sliding movement thereof. In addition, the single recess 64 on leg 40 and single recess 92 on leg 72 may be used maintaining the adjustable spacing of legs 38, 70.

Figure 16:
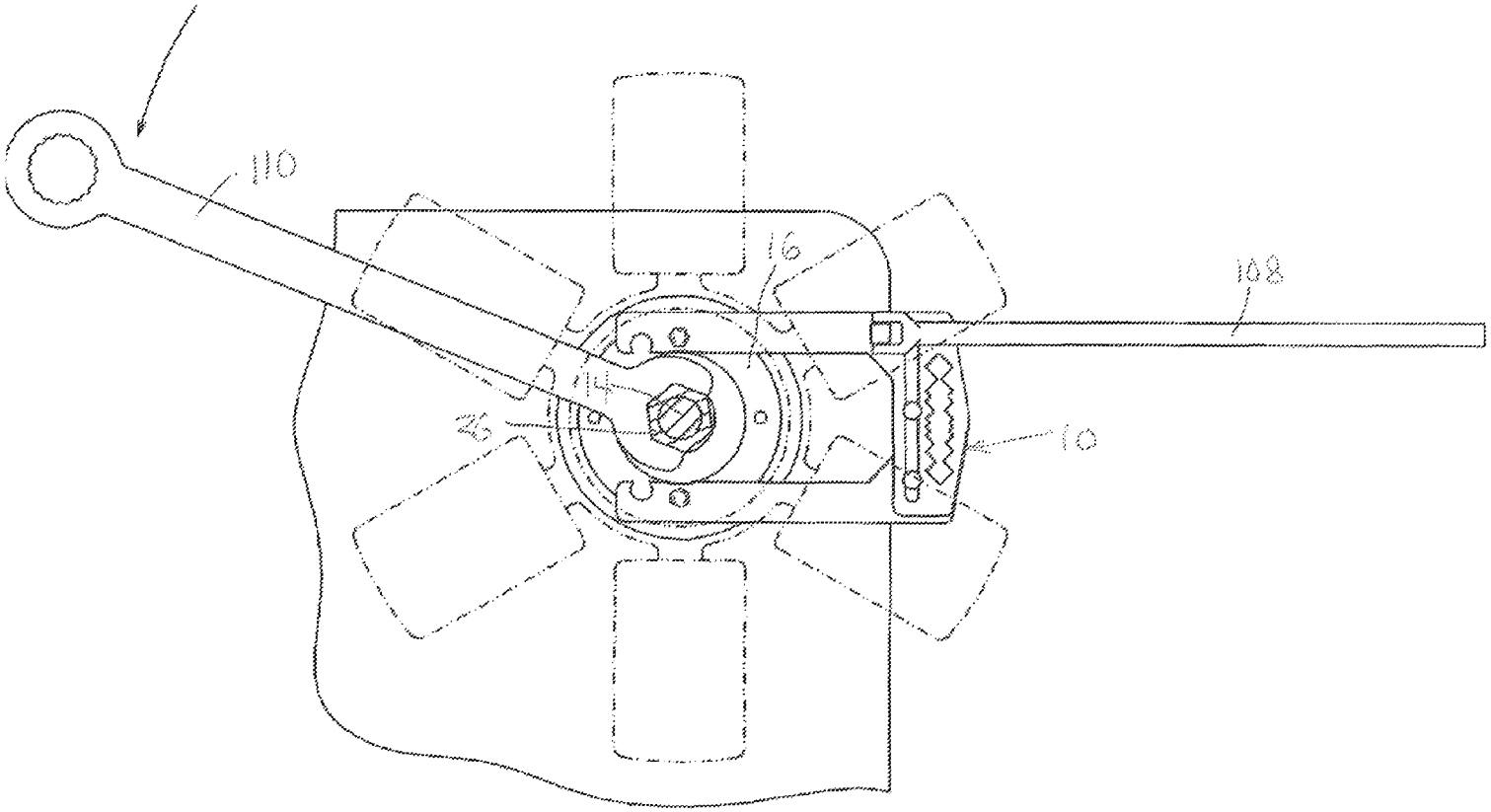
FIG. 16 is a perspective view showing use of a turning wrench once the holding tool is in place in order to effect separation of the fan clutch assembly from the water pump shaft.
Figure 17:
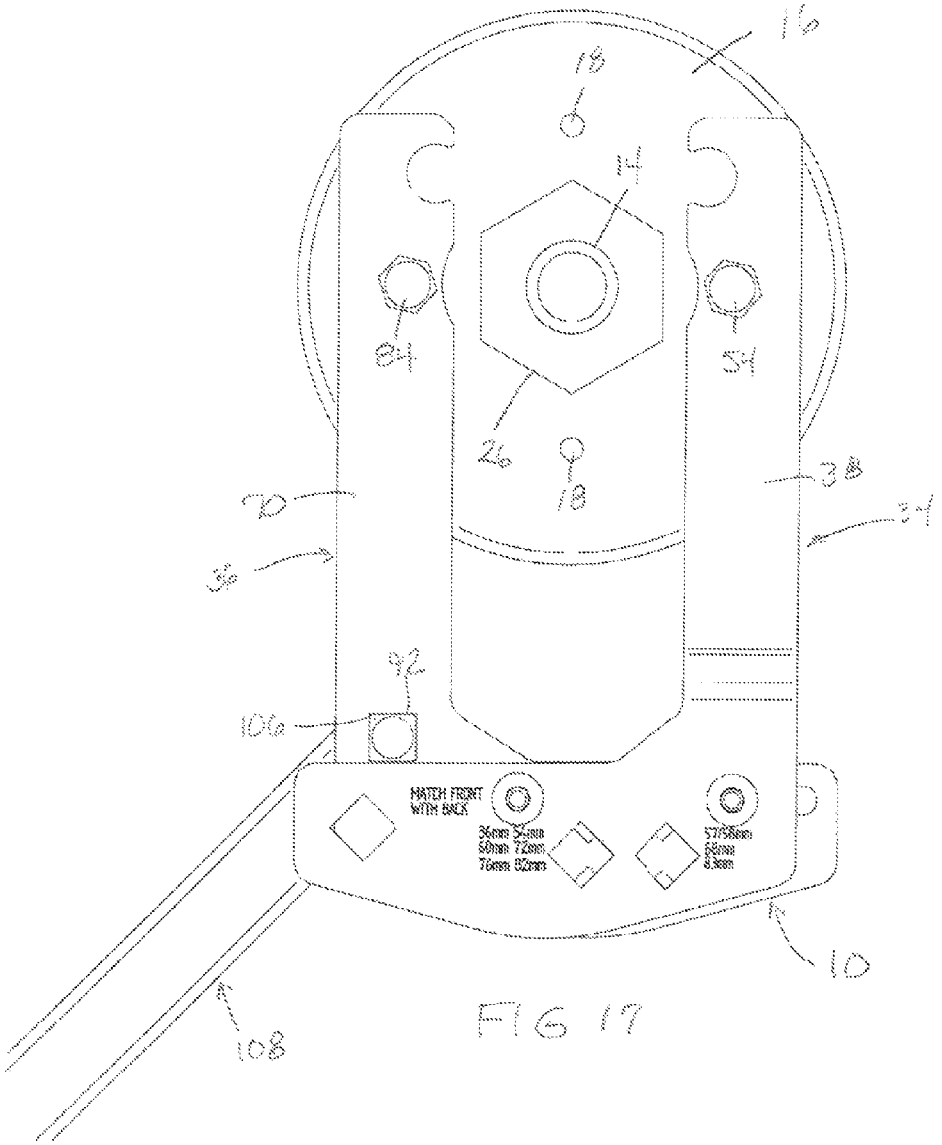
FIG. 17 is a top view of FIG. 14 showing the breaker bar in a different position.

When it is desired to service fan clutch assemblies or water pumps, the holding tool 10 is extremely versatile in adapting to various pulley designs and sizes used in today's vehicles. One such use of the holding tool 10, as applied to a first type of pulley (such as pressed on pulley 16 having recesses 18 formed in the outer face thereof) is illustrated in FIGS. 14 and 15. In these figures, the fan clutch nut 26 of the fan clutch assembly is shown removed therefrom and threaded upon the water pump shaft 14 in order to better explain the use of the tool 10. In this particular application, fasteners 54, 84 have been threaded into the holes 52, 82 on the plate holders 34, 36 so that the pins 60, 90 protrude rearwardly from the legs 38, 70. The plate holders 34, 36 are slidably adjusted to suitable vary the spacing of legs 38, 70 so that the pins 60, 90 are engaged with the walls of a pair of opposed recesses 18 in pulley 16. The facing arcuate cutouts 48, 74 on the legs 38, 70 allow for an easier placement of the tool 10 given the location of the nut 26 relative to the recesses 18 engaged by the pins 60, 90. A drive member 106 of a suitable tool, such as ratchet or breaker bar 108, is matingly received in the walls of recess 64 with the breaker bar 108 acting an extended handle to hold the tool 10 in position to keep the pulley 16 stationary or to provide torque, if desired. FIG. 17 shows a similar use of the tool 10 on pulley 16 for which the spacing of the legs 38, 70 is increased for the particular positioning of recesses 18. In this application, the drive member 106 of the breaker bar 108 is matingly received in the walls of recess 92. It should be appreciated from FIGS. 14 and 17 that the drive member 106 of the breaker bar 108 may be inserted from either the front or back of the tool 10 as desired by the user. As depicted in FIG. 16, once the holding tool 10 has been engaged with the pulley 16, the user engages the nut 26 of the fan clutch assembly with an appropriate open end turning wrench 110. The user, while holding the pulley 16 stationary with the tool 10, then turns wrench 110 in a loosening direction so as to unthread nut 26 and removes the hand clutch assembly from shaft 14. In the examples to follow, the appropriately sized turning wrench 110 is used to break the threaded nut connection between the shaft 14 and the fan clutch assembly once the holding tool 10 fixes the position of the particular pulley used.

Figure 18:
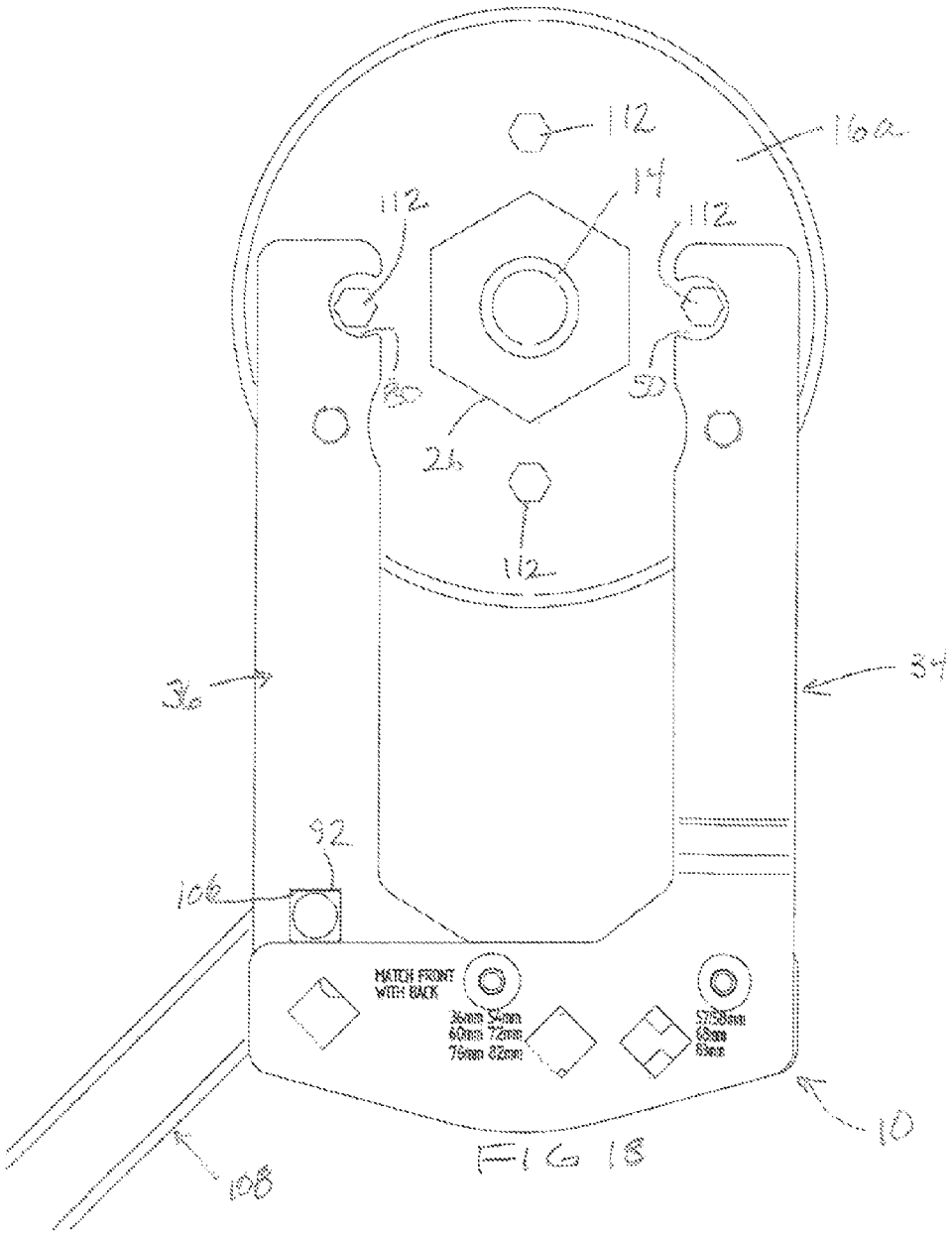
FIG. 18 is a view similar to FIG. 16 showing the holding tool engaged in an exemplary holding position on a second type of water pump pulley having protruding bolts.

FIG. 18 illustrates the use of holding tool 10 with a second type of bolt on pulley 16*a* having a series of spaced apart bolt heads 112 protruding therefrom. Here, the spacing of the legs 38, 70 is adjusted so that the walls of the facing arcuate notches 50, 80 engage a pair of the opposed bolt heads 112 so as to prevent pulley 16*a* from rotating. The drive member 106 of the breaker bar 108 is matingly received in the walls of recess 92 based on the particular spacing of the bolt heads 112 for pulley 16*a*.

Figure 19:
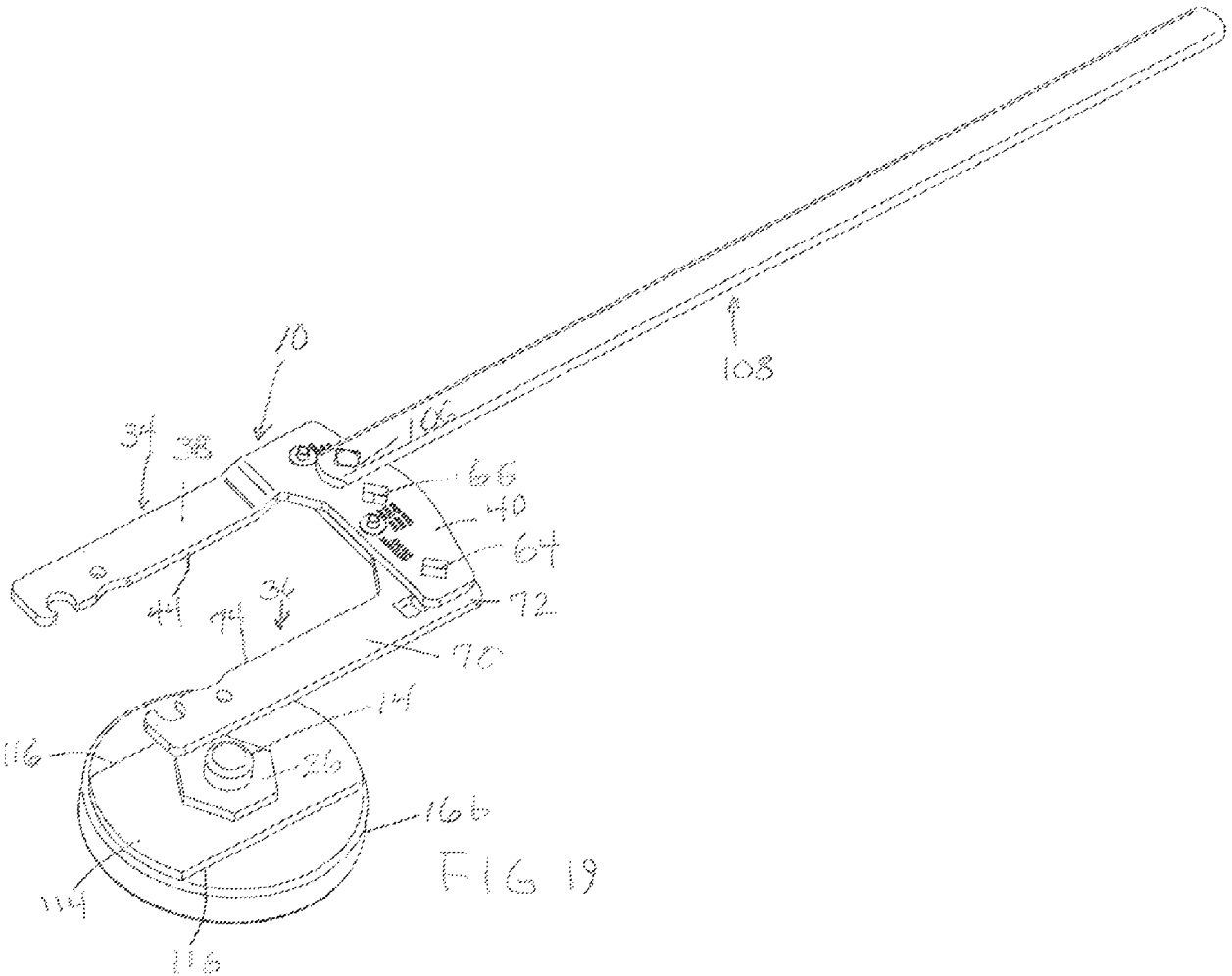
FIGS. 19 and 20 are perspective views of the holding tool engaged in an exemplary position on a third type of water pump pulley having raised flats.
Figure 20:
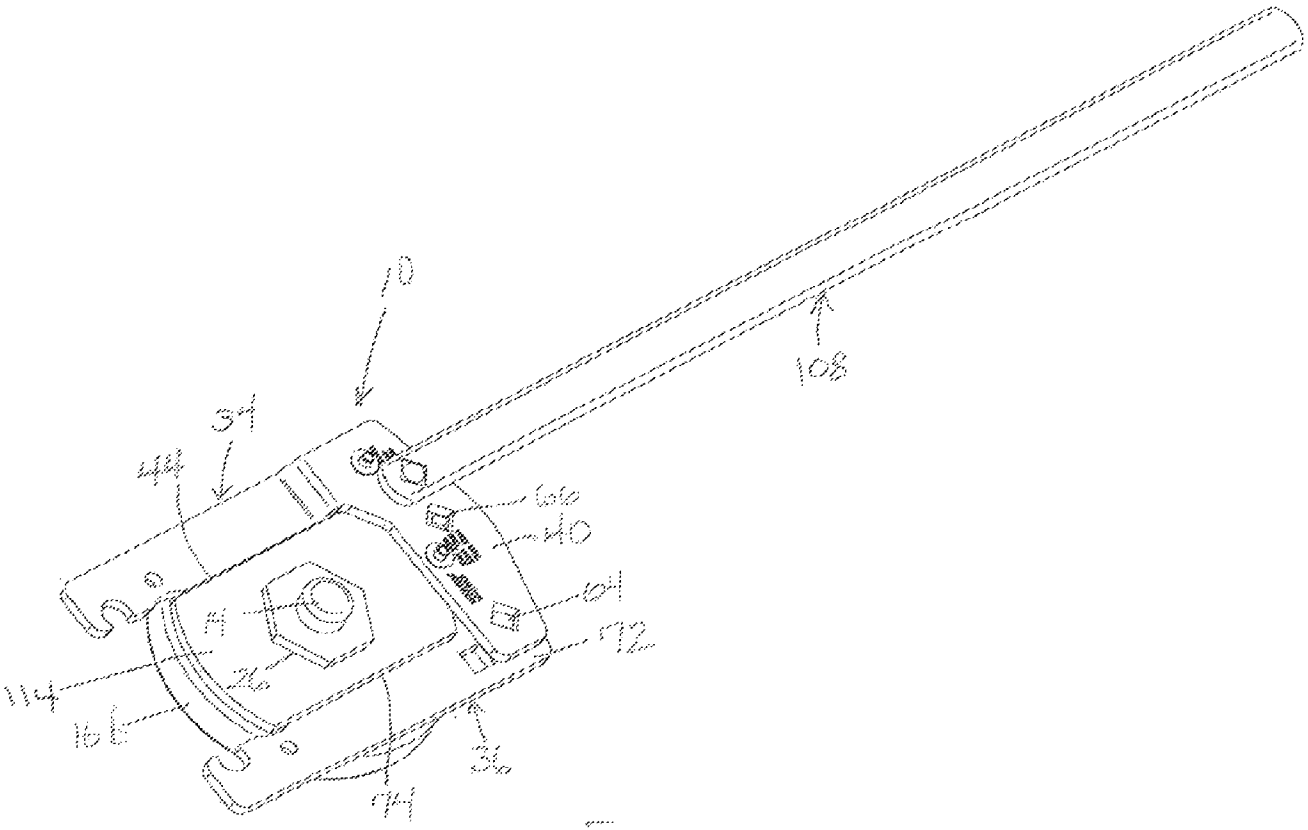

FIGS. 19 and 20 illustrate the use of holding tool 10 with a third type of pulley 16*b* having a raised surface 114 with upstanding opposed flat edges 116. In this application, the spacing of the legs 38, 70 is adjusted so that the inner edges 44, 74 of the respective legs 38, 70 engage the flat edges 116 to prevent pulley 16*b* from rotating. To lock in the required spacing of legs 38, 70, the drive member 106 of breaker bar 108 is then matingly received in the walls of aligned or matching recesses on the adjustment legs 40, 72 which correspond to the particular spacing required by the raised surface 14 on pulley 16*b*. In this example, the particular spacing of 83 mm between inner edges 44, 74 corresponds to the alignment of recess 68 on the right end of leg 40 with the portion of recess 98 created by the saw tooth edges 98, 100 on the left end of leg 72 as best understood from a review of FIGS. 5 and 6. Although not shown, it should be understood that the flat edges 116 may otherwise be effectively formed, such as by the outermost flat edges of a pair of bolts on each side of a pulley outer face.

Figure 21:
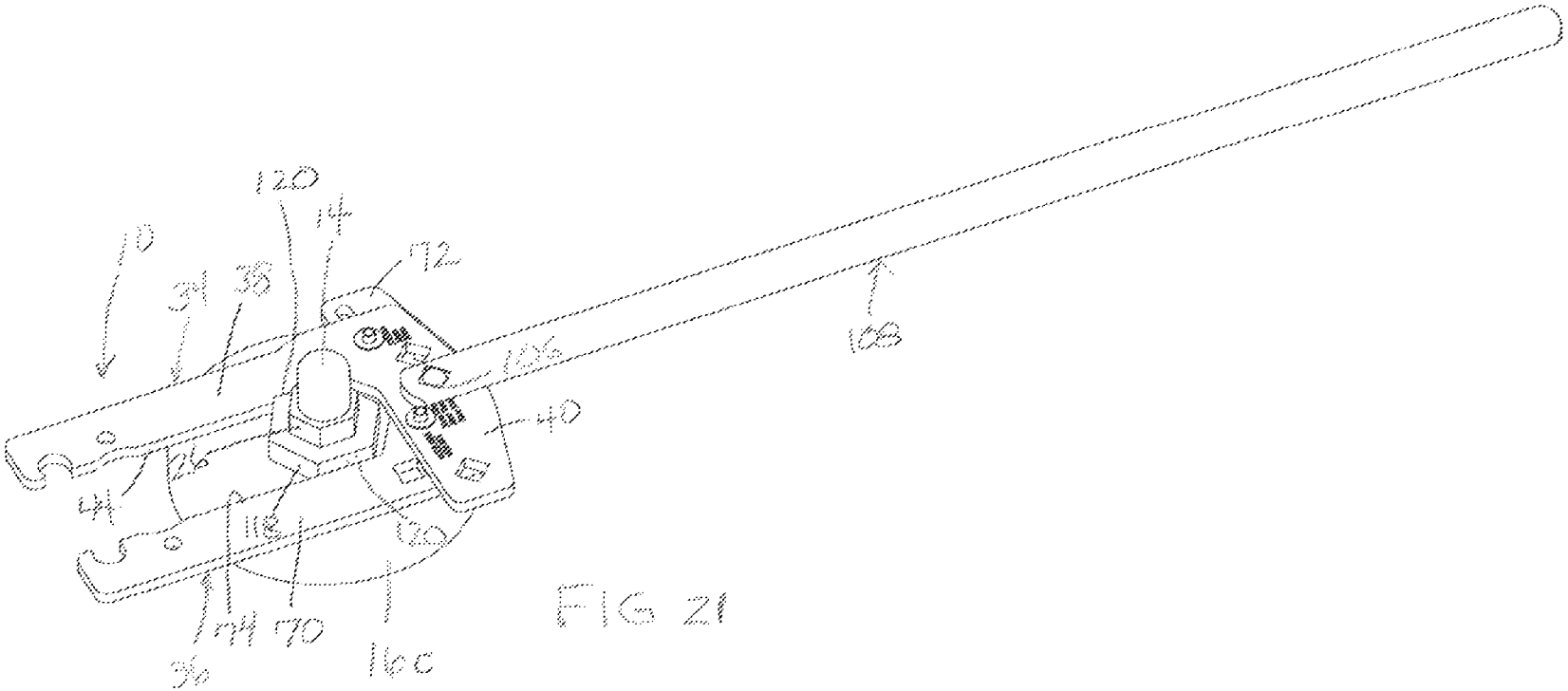
FIG. 21 is a perspective view of the holding tool engaged in an exemplary position on a fourth type of water pump pulley having a double nut.

FIG. 21 illustrates the use of holding tool 10 with a fourth type of pulley 16*c* having a double nut arrangement defined by a nut 118 fixed to the outer face of pulley 16*c* and shaft 14, and the fan clutch nut 26 which is threadably attached to the shaft 14. With this arrangement, spacing of legs 38, 70 is adjusted so that the inner edges 44, 74 of the respective legs 38, 70 engage the outermost edges 120 of nut 118 to prevent pulley 16*c* from rotating. In this example, drive member 106 of breaker bar 108 is matingly received in the aligned recesses on legs 40, 72 corresponding to the particular sides of nut 118. The aligned recesses are defined here by recess 66 on leg 40 and an intermediate portion of recess 96 defined by the saw tooth edges 98, 100.

Figure 22:
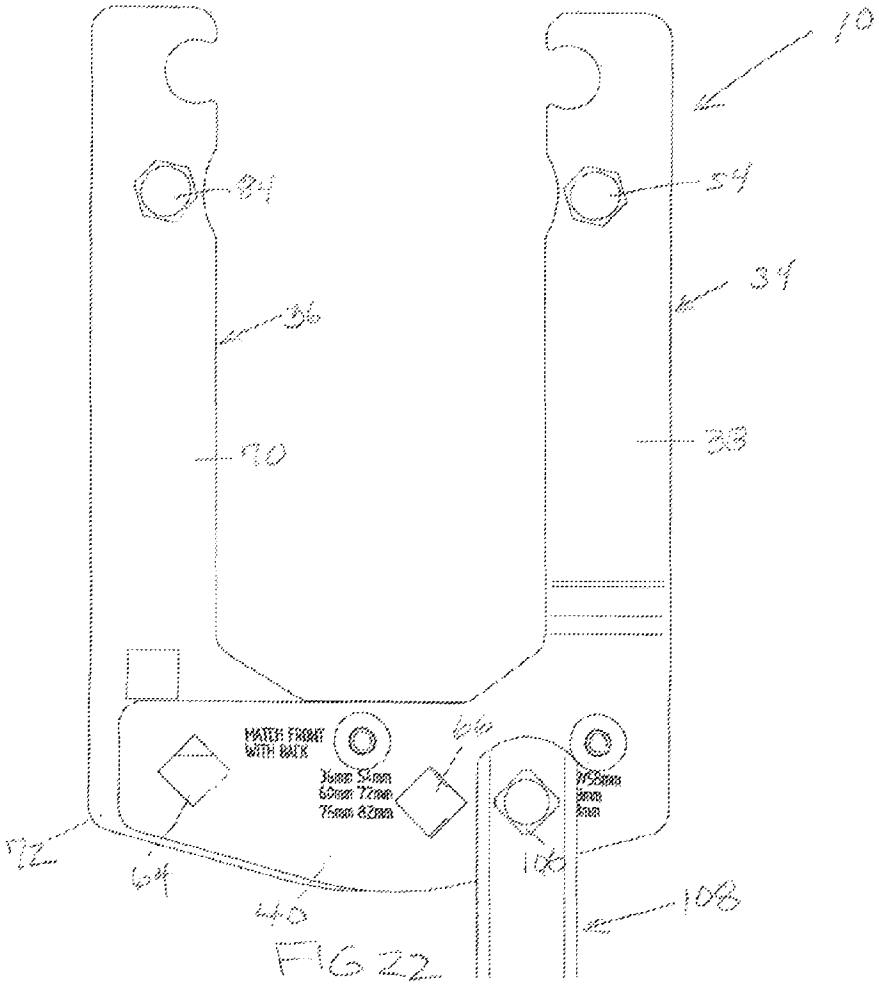

FIG. 22 illustrates the holding tool 10 as used with the pulley 16 of FIG. 17, but showing a different spacing of the legs 38, 70 corresponding to the locked position of the breaker bar 108 with the appropriately aligned recesses on the legs 40, 72.

FIG. 23 illustrates the holding tool of FIG. 22 but shows a further different spacing between legs 38, 70 corresponding to a different locked position of the breaker bar 108 with the appropriately aligned recesses on legs 40, 72.

From the foregoing examples, it can be seen that the pulleys 16, 16*a*, 16*b*, 16*c* have various engagement structures as defined by holes, bolts, raised flat edges, and nut arrangements which are differently shaped, sized and spaced. A key feature of the holding tool 10 resides in the provision of attachment structure defined by the inner edges 44, 74, the arcuate notches 50, 80, and the pins 54, 84, and the adaptability of the attachment structure to universally accommodate the various pulley engagement structures so as to maintain the pulley stationary when servicing the fan clutch assembly. It should be further understood that the recesses 64, 66, 68, 92, 96 define a holding structure engageable with a tool such as a breaker bar 108, to maintain the spacing of the attachment legs 38, 70.

Various alternatives are contemplated as being within the scope of the following particularly pointing out and distinctly claiming the subject matter regards as the invention.

The invention claimed is:

1. An adjustable holding tool for servicing a fan clutch assembly removably attached to a shaft of a water pump having a pulley associated therewith, the holding tool comprising:

a first plate holder including a first adjustment leg with a square recess joined to a first attachment leg having a first longitudinal axis and a first attachment structure engageable with the pulley;

a second plate holder including a second adjustment leg with a recess joined to a second attachment leg having a second longitudinal axis and a second attachment structure engageable with the pulley;

the recess of the second adjustment leg has a periphery defined by a plurality of teeth configured to align with the square recess of the first adjustment leg; and wherein the first and second plate holders are slidably connected together to provide a continuous variable spacing between the first and second adjustment legs while maintaining a substantially parallel relationship between the first and second longitudinal axes and wherein the square recess of the first adjustment leg is selectively alignable with the teeth of the recess of the second adjustment leg at various adjustment leg spacing to form a square through-hole in which a square drive is receivable.

2. The adjustable holding tool according to claim 1, wherein the first attachment structure comprises an inner edge of the first attachment leg and the second attachment structure comprises an inner edge of the second attachment leg.

3. The adjustable holding tool according to claim 1, wherein the first attachment structure comprises an arcuate notch located in the first attachment leg and the second attachment structure comprises an arcuate notch located in the second attachment leg.

4. The adjustable holding tool according to claim 1, wherein the first attachment structure comprises a pin located in the first attachment leg and the second attachment structure comprises a pin located in the second attachment leg.

5. The adjustable holding tool according to claim 1, wherein the second adjustment leg has a slot and the first adjustment leg has two fasteners extending therefrom slidably engaged with the slot to provide the slidable connection.

6. The adjustable holding tool according to claim 1, wherein the first adjustment leg has a plurality of spaced apart square recesses.

7. The adjustable holding tool according to claim 1, wherein the second adjustment leg further comprises a second square recess.

8. The adjustable holding tool according to claim 1, wherein the spacing between the first and second attachment legs is configured to be maintained by a square drive received in the through-hole.

* * * * *